US006506529B2

(12) United States Patent
Uchida et al.

(10) Patent No.: US 6,506,529 B2
(45) Date of Patent: Jan. 14, 2003

(54) TONER FOR DEVELOPING ELECTROSTATIC LATENT IMAGE

(75) Inventors: Masafumi Uchida, Hachioji (JP); Hiroshi Yamazaki, Hachioji (JP); Meizo Shirose, Hachioji (JP); Hajime Tadokoro, Hachioji (JP); Ken Ohmura, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/953,681

(22) Filed: Sep. 17, 2001

(65) Prior Publication Data

US 2002/0076636 A1 Jun. 20, 2002

(30) Foreign Application Priority Data

Sep. 18, 2000 (JP) ..... 2000-281849

(51) Int. Cl.[7] ..... G03G 9/097
(52) U.S. Cl. ..... 430/108.4; 430/137.15
(58) Field of Search ..... 430/108.4, 137.15

(56) References Cited

U.S. PATENT DOCUMENTS 4,960,664 A * 10/1990 Yamada et al. ..... 430/109
5,047,305 A * 9/1991 Uchida et al. ..... 430/110
6,153,347 A * 11/2000 Kabai et al. ..... 430/110

* cited by examiner

*Primary Examiner*—John Goodrow
(74) *Attorney, Agent, or Firm*—Bierman, Muserlian and Lucas

(57) ABSTRACT

A toner for developing an electrostatic latent image comprising a resin, a colorant and a releasing agent is disclosed. The releasing agent comprises a mixture of a plurality of compounds represented by formula (1) having difference carbon number of carbon atoms in $R_2$ $$R_1—(OCO—R_2)_n \quad (1)$$

wherein n represents an integer of 1 to 8 carbon atoms which may has a substituent, $R_1$ is a hydrocarbon group having from 1 to 40, $R_2$ is a hydrocarbon group having from 8 to 40 carbon atoms which may has a substituent.

12 Claims, 9 Drawing Sheets

TONER FOR DEVELOPING ELECTROSTATIC LATENT IMAGE

FIELD OF THE INVENTION

This invention relates to a toner for developing an electrostatic latent image, a production method of the toner for developing an electrostatic latent image and an image forming method using the toner for developing an electrostatic latent.

BACKGROUND OF THE INVENTION

At present, an electrostatic latent image developing method is widely applied in the image forming process of a copy machine, a printer and a facsimile machine because a high quality image can be formed at a high speed by such the method, the method can correspond to an analogue image forming process, a color image forming process and a digital image forming process and the method has a high accomplishment and a high stability and a durability of the performance.

Accordingly, a demand to the method to raise the image quality is strong and a further improvement in the image quality is required. As the countermeasure to such the requirement, it has been investigated as the most effective way that the particle size of the toner for developing electrostatic latent image, hereinafter simply referred to the toner, is made small and the particle size distribution width of the toner particles is made narrow.

The toner produced by a polymerization is preferable to form a high quality image since the toner having a small particle size and a narrow size distribution can be easily obtained by the polymerization method. However, a releasing agent is not exposed at the surface of the toner particle produced by the polymerization method. The toner produced by such the method has problems that the fixing ability by a thermal fixation is low and a toner off-set is occurred to the surface of the heating member of the fixing device.

SUMMARY OF THE INVENTION

The object of the invention is to provide a toner with a high fixing ability and without occurring of the off-set, by which an image can be formed stably for a long duration, a production method of such the toner and an image forming method using the toner. The other object of the invetion is to provide a toner with minimized filming problem on a photoreceptor and deformation of image blurring. The other object of the invention is to provide a toner having excellent fixing characteristics and giving high image quality after long storage.

The invention and an embodiment thereof are described below.

1. A toner for developing an electrostatic latent image comprising a resin, a colorant and a releasing agent, the releasing agent comprising a mixture of a plurality of compounds represented by formula (1)

$$R_1—(OCO—R_2)_n \quad (1)$$

wherein n represents an integer of 1 to 8 carbon atoms which may has a substituent, $R_1$ is a hydrocarbon group having from 1 to 40, $R_2$ is a hydrocarbon group having from 8 to 40 carbon atoms which may has a substituent, wherein the mixture is composed of (a) from 80 to 90 weight % of the compound represented by Formula (1), $R_2$ of which has N carbon atoms, from 3.0 to 10.0 weight % of the compound represented by Formula (1), $R_2$ of which has N−2 carbon atoms, from 1.0 to 5.0 weight % of the compound represented by Formula (1), $R_2$ of which has N−4 carbon atoms, from 0.1 to 2.0 weight % of the compound represented by Formula (1), $R_2$ of which has N−6 carbon atoms, and from 0.5 to 3.0 weight % of the compound represented by Formula (1), $R_2$ of which has N+2 carbon atoms, or (b) from 80 to 90 weight % of the compound represented by Formula (1), $R_1$ of which has N carbon atoms, from 3.0 to 10.0 weight % of the compound represented by Formula (1), $R_1$ of which has N−2 carbon atoms, from 1.0 to 5.0 weight % of the compound represented by Formula (1), $R_1$ of which has N−4 carbon atoms, from 0.1 to 2.0 weight % of the compound represented by Formula (1), $R_1$ of which has N−6 carbon atoms, and from 0.5 to 3.0 weight % of the compound represented by Formula (1), $R_1$ of which has N+2 carbon atoms.

In the toner mentioned above, (a) is preferable. Preferable N is from 8 to 36, and more preferably from 8 to 30.

When n is 1, $R_1$ is a hydrocarbon group preferably having carbon atoms of from 13 to 31.

When n is from 2 to 8, $R_1$ is a hydrocarbon group preferably having carbon atoms of from 2 to 15.

Preferably n is 3 or 4, and more preferably 4.

The toner particle is composed of preferably fused resinous particles containing the releasing agent.

The toner is preferably obtained by fusing resinous particles containing the releasing agent in a water based medium.

In the other embodiment, the toner is obtained by fusing, in water based medium, resinous particles containing the releasing agent and colorant.

In the further other embodiment, the toner is obtained by suspension polymerization of monomer composition containing monomer, the releasing agent and colorant in water based medium.

DETAILED DESCRIPTION OF THE INVENTION

Figure 1:
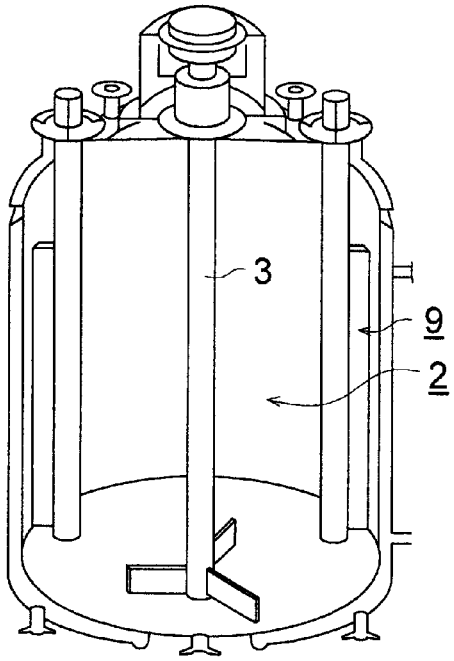
FIG. 1 is a perspective view of one example of a stirring tank equipped with conventional stirring blades.

The invention is described in detail below.

The invention provides a toner having a sufficient fixing ability, anti-off-set property at the fixing process and durability, a production method of the toner and an image forming method using the toner.

In the toner produced by a polymerization occurred in a water based medium containing a releasing agent, the releasing agent is locally distributed interior of the particle and the amount of the releasing agent exposed at the particle surface is small. Therefore, the effect of the releasing agent at the thermal fixing is difficultly displayed, and the fixing ability is made low and the off-set at the fixing process tends to be occurred.

The fixing ability and the anti-off-set property at the thermal fixation can be improved by making the construction of the toner so that the releasing agent is exposed at the surface of the toner particle even when the toner is produced by the polymerization method. However, such the toner is not preferable since the releasing agent tens to cause an image fault by adhering to the carrier and the developing sleeve at the time of image formation to lower the charging property of the toner and by forming the toner film on the photoreceptor surface.

The inventors consider that it is important to effectively melt-out the releasing agent locally distributed interior of the toner particle to the surface at the time of fixation.

Particularly, the inventor have investigate to accelerate the effect of the releasing agent by raising the melting-out speed of the releasing agent to the toner particle surface by heat at the time of fixation and found that the object of the invention can be attained by the use of plural compounds each represented by Formula 1 and different in the number of the carbon atoms from each other.

It is presumed that the spreading of the releasing agent by heating can be accelerated by the melting-point lowering by the mixing effect of the compounds different in the number of the carbon atoms from each other even though the reason of such the effect is not be cleared. When the compound represented by formula (1) is employed solely, filming problem on a photoreceptor was occurred because the compound has high cleavage property and spreading property. On the other hand natural wax such as carnauba wax, which has been employed for the releasing agent for the toner, does not give sufficient fixing ability. It is presumed the wax is not a pure compound but a mixture of a plurality of compounds.

The releasing agent of the invention, a mixture of the compounds represented by formula (1), having disturbed crystalline property partly and maintaining crystalline property partly gives excellent fixing characteristics with minimized filming problem.

<Toner According to the Invention>

The releasing agent contained in the toner is a mixture of plural ester compounds each represented by Formula 1 and different from each other in the carbon atoms represented by $R_2$.

In Formula 1, n is an integer of from 1 to 8, preferably from 1 to 4, more preferably from 2 to 4, further preferably from 3 to 4 and particularly preferably 4.

$R_1$ is a hydrocarbon group having carbon atoms of from 1 to 40, preferably from 1 to 20, more preferably from 2 to 5, the hydrocarbon group may have a substituent. $R_1$ is a hydrocarbon group having carbon atoms of preferably from 13 to 31, more preferably from 17 to 28 when n is 1, and preferably from 2 to 15, more preferably from 2 to 4 when n is from 2 to 8.

Number of carbon atoms in $R_1$ and $R_2$ are measured by means of mass spectroscopy.

$R_2$ is a hydrocarbon group having from 8 to 40, preferably from 13 to 31, particularly preferably from 17 to 28 carbon atoms which may has a substituent. $R_2$ is preferably a saturated hydrocarbon group. When the number of the carbon atoms of $R_2$ of one compound is N, the content of the compound having the carbon number N in the mixture of the ester compounds is from 80 to 98% by weight, that of the compound having the carbon number of $R_2$ less than N by 2 (that is, N—2) is from 3.0 to 10.0% by weight, that of the compound having the carbon number of $R_2$ of N−4 is from 1.0 to 5.0% by weight, that of the compound having the carbon number of $R_2$ of N−6 is from 0.1 to 2.0% by weight and that of the compound having the carbon number of $R_2$ of N+2 is from 0.5 to 3.0% by weight. N is preferably from 8 to 36, more preferably from 8 to 30.

Concrete examples of the ester compound usable in the invention are shown below.

1) $CH_3—(CH)_{12}—COO—(CH_2)_{17}—CH_3$

2) $CH_3—(CH)_{18}—COO—(CH_2)_{17}—CH_3$

3) $CH_3—(CH)_{20}—COO—(CH_2)_{21}—CH_3$

4) $CH_3—(CH)_{14}—COO—(CH_2)_{19}—CH_3$

5) $CH_3—(CH)_{20}—COO—(CH_2)_6—O—CO—(CH)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

12) $CH_2—OH$
$CH—O—CO—(CH_2)_{26}—CH_3$
$CH_2—O—CO—(CH_2)_{26}—CH_3$

13) $CH_2—OH$
$CH—O—CO—(CH_2)_{22}—CH_3$
$CH_2—O—CO—(CH_2)_{22}—CH_3$

-continued

14)

$$\begin{array}{l} CH_2—OH \\ | \\ CH—OH \\ | \\ CH_2—O—CO—(CH_2)_{26}—CH_3 \end{array}$$

15)

$$\begin{array}{l} CH_2—OH \\ | \\ CH—OH \\ | \\ CH_2—O—CO—(CH_2)_{22}—CH_3 \end{array}$$

16)

$$\begin{array}{l} \qquad\qquad\qquad\qquad CH_3 \\ \qquad\qquad\qquad\qquad | \\ CH_3—(CH_2)_{26}—COO—CH_2—C—CH_2—O—CO—(CH_2)_{26}—CH_3 \\ \qquad\qquad\qquad\qquad | \\ \qquad\qquad\qquad\qquad CH_2—O—CO—(CH_2)_{26}—CH_3 \end{array}$$

17)

$$\begin{array}{l} \qquad\qquad\qquad\qquad CH_2CH_3 \\ \qquad\qquad\qquad\qquad | \\ CH_3—(CH_2)_{20}—COO—CH_2—C—CH_2—O—CO—(CH_2)_{20}—CH_3 \\ \qquad\qquad\qquad\qquad | \\ \qquad\qquad\qquad\qquad CH_2—O—CO—(CH_2)_{20}—CH_3 \end{array}$$

18)

$$\begin{array}{l} \qquad\qquad\qquad\qquad CH_2—O—CO—(CH_2)_{26}—CH_3 \\ \qquad\qquad\qquad\qquad | \\ CH_3—(CH_2)_{26}—COO—CH_2—C—CH_2—O—CO—(CH_2)_{26}—CH_3 \\ \qquad\qquad\qquad\qquad | \\ \qquad\qquad\qquad\qquad CH_2—O—CO—(CH_2)_{26}—CH_3 \end{array}$$

19)

$$\begin{array}{l} \qquad\qquad\qquad\qquad CH_2—O—CO—(CH_2)_{24}—CH_3 \\ \qquad\qquad\qquad\qquad | \\ CH_3—(CH_2)_{24}—COO—CH_2—C—CH_2—O—CO—(CH_2)_{24}—CH_3 \\ \qquad\qquad\qquad\qquad | \\ \qquad\qquad\qquad\qquad CH_2—O—CO—(CH_2)_{24}—CH_3 \end{array}$$

20)

$$\begin{array}{l} \qquad\qquad\qquad\qquad CH_2—O—CO—(CH_2)_{22}—CH_3 \\ \qquad\qquad\qquad\qquad | \\ CH_3—(CH_2)_{22}—COO—CH_2—C—CH_2—O—CO—(CH_2)_{22}—CH_3 \\ \qquad\qquad\qquad\qquad | \\ \qquad\qquad\qquad\qquad CH_2—O—CO—(CH_2)_{22}—CH_3 \end{array}$$

21)

$$\begin{array}{l} \qquad\qquad\qquad\qquad CH_2—O—CO—(CH_2)_{20}—CH_3 \\ \qquad\qquad\qquad\qquad | \\ CH_3—(CH_2)_{20}—COO—CH_2—C—CH_2—O—CO—(CH_2)_{20}—CH_3 \\ \qquad\qquad\qquad\qquad | \\ \qquad\qquad\qquad\qquad CH_2—O—CO—(CH_2)_{20}—CH_3 \end{array}$$

22)

$$\begin{array}{l} \qquad\qquad\qquad\qquad CH_2—O—CO—(CH_2)_{18}—CH_3 \\ \qquad\qquad\qquad\qquad | \\ CH_3—(CH_2)_{18}—COO—CH_2—C—CH_2—O—CO—(CH_2)_{18}—CH_3 \\ \qquad\qquad\qquad\qquad | \\ \qquad\qquad\qquad\qquad CH_2—O—CO—(CH_2)_{18}—CH_3 \end{array}$$

23)

$$\begin{array}{l} \qquad\qquad\qquad\qquad CH_2—O—CO—(CH_2)_{16}—CH_3 \\ \qquad\qquad\qquad\qquad | \\ CH_3—(CH_2)_{16}—COO—CH_2—C—CH_2—O—CO—(CH_2)_{16}—CH_3 \\ \qquad\qquad\qquad\qquad | \\ \qquad\qquad\qquad\qquad CH_2—O—CO—(CH_2)_{16}—CH_3 \end{array}$$

24)

$$\begin{array}{l} \qquad\qquad\qquad\qquad CH_2—O—CO—(CH_2)_{14}—CH_3 \\ \qquad\qquad\qquad\qquad | \\ CH_3—(CH_2)_{14}—COO—CH_2—C—CH_2—O—CO—(CH_2)_{14}—CH_3 \\ \qquad\qquad\qquad\qquad | \\ \qquad\qquad\qquad\qquad CH_2—O—CO—(CH_2)_{14}—CH_3 \end{array}$$

25)

$$\begin{array}{l} \qquad\qquad\qquad\qquad CH_2—O—CO—(CH_2)_{12}—CH_3 \\ \qquad\qquad\qquad\qquad | \\ CH_3—(CH_2)_{12}—COO—CH_2—C—CH_2—O—CO—(CH_2)_{12}—CH_3 \\ \qquad\qquad\qquad\qquad | \\ \qquad\qquad\qquad\qquad CH_2—O—CO—(CH_2)_{12}—CH_3 \end{array}$$

-continued

26)

$$\begin{array}{l} \qquad\qquad\qquad\qquad CH_2—O—CO—(CH_2)_{10}—CH_3 \\ \qquad\qquad\qquad\qquad | \\ CH_3—(CH_2)_{10}—COO—CH_2—C—CH_2—O—CO—(CH_2)_{10}—CH_3 \\ \qquad\qquad\qquad\qquad | \\ \qquad\qquad\qquad\qquad CH_2—O—CO—(CH_2)_{10}—CH_3 \end{array}$$

The content ratio of a releasing agent, wax or ester wax in the toner of the present invention is commonly from 1 to 30 percent by weight, is preferably from 2 to 20 percent by weight, and is more preferably from 3 to 15 percent by weight.

Further, toner binder resins are preferably comprised of both high molecular weight components having a peak or shoulder in the molecular weight range of from 100,000 to 1,000,000 and low molecular weight components having a peak or shoulder in the molecular weight range of from 1,000 to 20,000 measured by means of gel permeation chromatography (GPC).

The molecular weight of said resins is measured utilizing a GCP (gel permeation chromatography) in which THF is used as the solvent. The weight of the sample generally ranges from 0.5 to 5 mg. More specially, 1 mg of the sample is added to 1 ml of THF, and is completely dissolved at room temperature, utilizing a magnetic stirrer and the like. Subsequently, after treating the resulting solution, employing a membrane filter having a pore size of from 0.45 to 0.50 $\mu$m, the resulting solution is injected into said GCP. Measurement is carried out under conditions that the column is stabilized at 40° C., THF flows at a rate of 1 ml per minute, and about 100 $\mu$l of the sample at a concentration of 1 mg/ml is injected. Columns are preferably employed in combinations of commercially available polystyrene columns.

It is possible to cite combinations of Shodex GCP KF -801, 802, 803, 804, 805, 806, and 807, manufactured by Showa Denko Co., Ltd. and combinations of TSKgel G1000H, G2000H, G3000H, G4000H, G5000H, G6000H, G7000H, TSK guard column, manufactured by Tosoh Corp., and the like. Further, preferably employed as detectors are refractive index detectors (IR detectors) or UV detectors. The molecular weight of each sample is calculated utilizing a calibration curve in which the molecular weight distribution of said sample is prepared employing standard monodispersed polystyrene particles. It is preferable that said calibration curve is dawn connecting tens points obtained by said standard polystyrene particles.

It is possible to prepare the toner of the present invention in such a manner that fine polymerized particles are produced employing a suspension polymerizing, an emulsion polymerization or a mini-emulsion polymerization.

Since smaller particles than those necessary to employ by themselves are obtained by the emulsion polymerization or mini-emulsion polymerization, the smaller particles are gathered to form particles having size for toner particles by association.

In the emulsion polymerization or mini-emulsion polymerization method the colorant and additives, if necessary, may be incorporated in resinous particles during polymerization process or association process. The monomers are polymerized in a liquid added with the colorant and the necessary additives, and thereafter, association is carried out by adding organic solvents, coagulants, and the like, in the former way. In the latter way polymerized resin particles are subjected to associating upon mixing dispersions of the additives, and the colorant and the additives are included in toner particles. Association as described herein means that a plurality of resin particles and colorant particles are fused.

Since smaller particles than those necessary to employ by themselves are obtained by the emulsion polymerization or mini-emulsion polymerization, the smaller particles are gathered to form particles having size for toner particles by association.

In the emulsion polymerization or mini-emulsion polymerization method the colorant and additives, if necessary, may be incorporated in resin particles during polymerization process or association process. The monomers are polymerized in a liquid added with the colorant and the necessary additives, and thereafter, association is carried out by adding organic solvents, coagulants, and the like, in the former way. In the latter way polymerized resin particles are subjected to associating upon mixing dispersions of the additives and the colorant and the additives are included in toner particles. Association as described herein means that a plurality of resinous particles and colorant particles are fused.

The water based medium means one in which at least 50 percent, by weight of water, is incorporated.

Namely, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating. After completing the reaction, the dispersion stabilizers are removed, filtered, washed, and subsequently dried. In this manner, the toner of the present invention is prepared.

Further, listed as a method for preparing said toner may be one in which resinous particles are associated, or fused, in a water based medium. Said method is not particularly limited but it is possible to list, for example, methods described in Japanese Patent Publication Open to Public Inspection Nos. 5-265252, 6-329947, and 9-15904. Namely, it is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chloro-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy -2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane)propane, tris-(t-butylperoxy) triazine, and the like; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 100,000, which can be measured employing gel permeation chromatography. Further preferred as resins are those having a molecular weight distribution of Mw/Mn of 1.5 to 100, and is most preferably between 1.8 and 70.

Employed coagulants are not particularly limited, but those selected from metal salts are more suitable. Specifically, listed as univalent metal salts are salts of alkaline metals such as, for example, sodium, potassium, lithium, and the like; listed as bivalent metal salts are salts of alkali earth metals such as, for example, calcium, magnesium, and salts of manganese, copper, and the like; and listed as trivalent metal salts are salts of iron, aluminum, and the like. Listed as specific salts may be sodium chloride, potassium chloride, lithium chloride, calcium chloride, zinc chloride, copper sulfate, magnesium sulfate, manganese sulfate, and the like. These may also be employed in combination.

These coagulants are preferably added in an amount higher than the critical coagulation concentration. The critical coagulation concentration as described herein means an index regarding the stability of water based dispersion and concentration at which coagulation occurs through the addition of coagulants. Said critical coagulation concentration markedly varies depending on emulsified components as well as the dispersing agents themselves. Said critical coagulation concentration is described in, for example, Seizo Okamura, et al., "Kobunshi Kagaku (Polymer Chemistry) 17", 601 (1960) edited by Kobunshi Gakkai, and others. Based on said publication, it is possible to obtain detailed critical coagulation concentration. Further, as another method, a specified salt is added to a targeted particle dispersion while varying the concentration of said salt; the ξ potential of the resultant dispersion is measured, and the critical coagulation concentration is also obtained as the concentration at which said ξ potential varies.

The acceptable amount of the coagulating agents of the present invention is an amount of more than the critical coagulation concentration. However, said added amount is preferably at least 1.2 times as much as the critical coagulation concentration, and is more preferably 1.5 times.

The solvents, which are infinitely soluble as described herein, mean those which are infinitely soluble in water, and in the present invention, such solvents are selected which do not dissolve the formed resins. Specifically, listed may be alcohols such as methanol, ethanol, propanol, isopropanol, t-butanol, methoxyethanol, butoxyethanol, and the like. Ethanol, propanol, and isopropanol are particularly preferred.

The added amount of infinitely soluble solvents is preferably between 1 and 100 percent by volume with respect to the polymer containing dispersion to which coagulants are added.

Incidentally, in order to make the shape of particles uniform, it is preferable that colored particles are prepared, and after filtration, the resultant slurry, containing water in an amount of 10 percent by weight with respect to said particles, is subjected to fluid drying. At that time, those having a polar group in the polymer are particularly preferable. For this reason, it is assumed that since existing water somewhat exhibits swelling effects, the uniform shape particularly tends to be made.

The toner can be employed in combination with the other toners for full color imaging. A colorant can be incorporated in the toner.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

When employed as a magnetic toner, it is possible to add said magnetite. In that case, from the viewpoint of providing specified magnetic properties, said magnetite is incorporated into said toner preferably in an amount of 20 to 60 percent by weight.

Employed as said organic pigments may be those conventionally known in the art. Specific organic pigments are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed.

Releasing agent employed in the invention can be mentioned as compounds represented by formula (1).

Employed as charge control agents may also be various types of those which are known in the art and can be dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of said medium in the reaction vessel. Subsequently, oil droplets in the water based medium in a suspension state gradually undergo polymerization. When the polymerized oil droplets become soft particles, the coagulation of particles is promoted through collision and particles having an undefined shape are obtained.

In the suspension polymerization method, it is possible to form a turbulent flow employing specified stirring blades and to readily control the resultant shape of particles. The reason for this phenomenon is not clearly understood. When the stirring blades 4 are positioned at one level, as shown in FIG. 1 (perspective view), the medium in stirring tank flows only from the bottom part to the upper part along the wall. Due to that, a conventional turbulent flow is commonly formed and stirring efficiency is enhanced by installing turbulent flow forming member (baffle) 9 on the wall surface of stirring tank 2. Though in said stirring apparatus, the turbulent flow is locally formed, the presence of the formed turbulent flow tends to retard the flow of the medium. As a result, shearing against particles decreases to make it almost impossible to control the shape of particles.

Reaction apparatuses provided with stirring blades, which are preferably employed in a suspension polymerization method, will be described with reference to the drawings.

Figure 2:
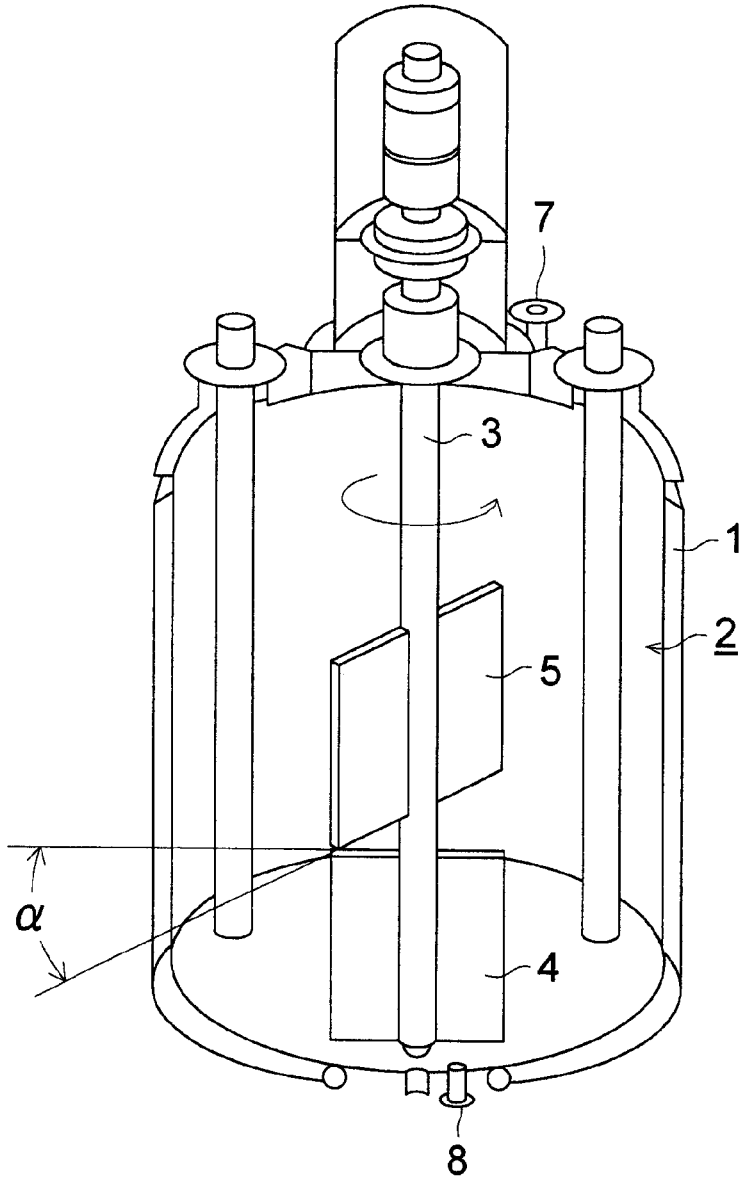
FIG. 2 is a perspective view of one example of a stirring tank equipped with stirring blades.
Figure 3:
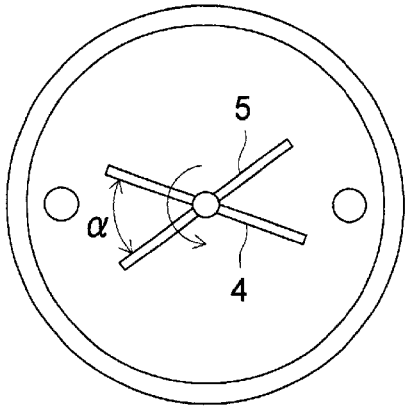
FIG. 3 is a cross-sectional view of the stirring tank shown in FIG. 2, viewed from above.

FIGS. 2 is an example of a perspective view of the reaction apparatus having two-leveled stirring blades. The shape of the blade can be modified and the turbulent flow forming member can be installed according to the embodiments. Rotating shaft 3 is installed vertically at the center in vertical type cylindrical stirring tank of which exterior circumference of the stirring tank is equipped with a heat exchange jacket, and said rotating shaft 3 is provided with lower level stirring blades 4 installed near the bottom surface of said stirring tank 4 and upper level stirring blade 5. The upper level stirring blades 5 are arranged with respect to the lower level stirring blade so as to have a crossed axis angle $\alpha$ advanced in the rotation direction. When the toner of the presents invention is prepared, said crossed axis angle $\alpha$ is preferably less than 90 degrees. The lower limit of said crossed axis angle $\alpha$ is not particularly limited, but it is preferably at least about 5 degrees, and is more preferably at least 10 degrees. Incidentally, when stirring blades are constituted at three levels, the crossed axis angle between adjacent blades is preferably less than 90 degrees.

By employing the constitution as described above, it is assumed that, firstly, a medium is stirred employing stirring blades 5 provided at the upper level, and a downward flow is formed. It is also assumed that subsequently, the downward flow formed by upper level stirring blades 5 is accelerated by stirring blades 4 installed at a lower level, and another flow is simultaneously formed by said stirring blades 5 themselves, as a whole, accelerating the flow. As a result, it is further assumed that since a flow area is formed which has large shearing stress in the turbulent flow, it is possible to control the shape of the resultant toner.

In FIG. 2, arrows show the rotation direction, reference numeral 7 is upper material charging inlet, 8 is a lower material charging inlet. In FIG. 1 reference numeral 9 is a turbulent flow forming member.

Herein, the shape of the stirring blades is not particularly limited, but employed may be those which are in square plate shape, blades in which a part of them is cut off, blades having at least one opening in the central area, having a so-called slit, and the like.

Figure 4:
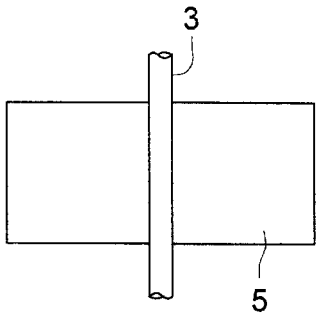
FIG. 4 is a schematic view of various stirring blades.
Figure 4:
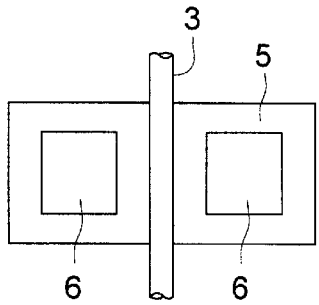
Figure 4:
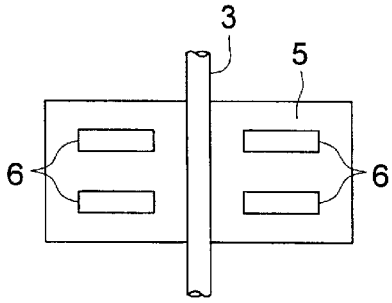
Figure 4:
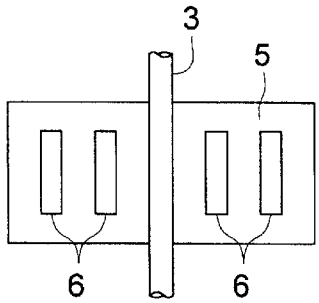
Figure 5:
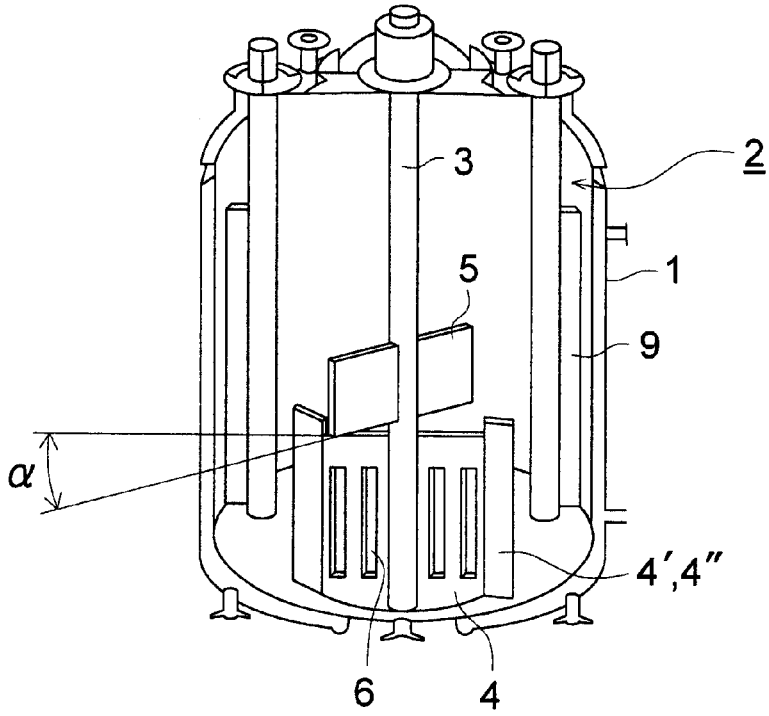
FIG. 5 is a perspective view of one example of a stirring tank equipped with stirring blades.

FIGS. 4(*a*), 4(*b*), 4(*c*), and 4(*d*) describe specific examples of the shape of said blades. Stirring blade shown in FIG. 4(*a*) has no central opening; stirring blade shown in FIG. 4(*b*) has large central opening areas 6; stirring blade 5 shown in FIG. 4(*c*) has rectangular openings 6 (slits); and stirring blade 5 shown in FIG. 4(*d*) has oblong openings 6 shown in FIG. 4(*d*). Further, when stirring blades of a three-level configuration are installed, openings which are formed at the upper level stirring blade and the openings which are installed in the lower level may be different or the same.

Figure 6:
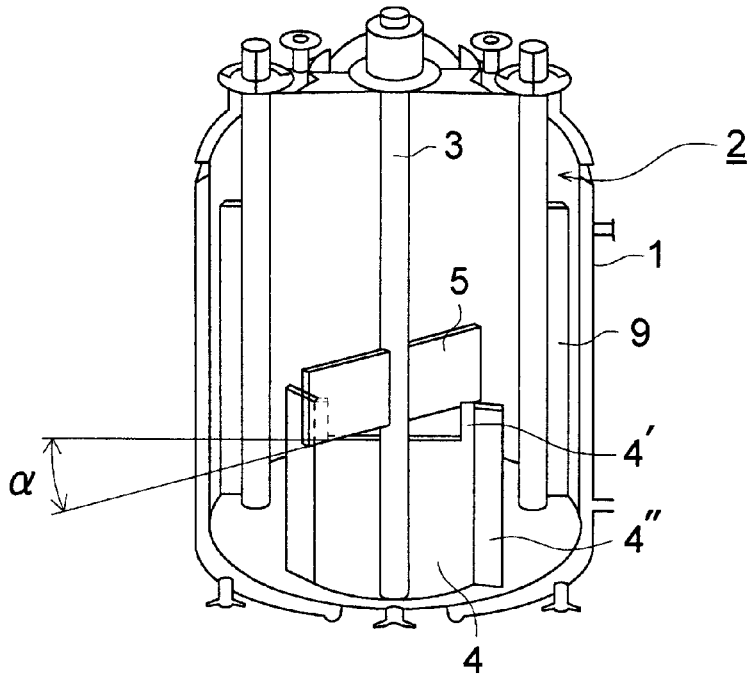
FIG. 6 is a perspective view of another example of a stirring tank equipped with stirring blades.

FIGS. 5 through 9 each show a perspective view of a specific example of a reaction apparatus equipped with stirring blades which may be preferably employed. In the reaction apparatus shown in FIG. 5, projections and/or folded parts are formed on the end portion of stirring blade. In FIG. 6 fins, folded parts are formed on the end portion of lower level stirring blade as well as slits are formed on the lower level stirring blade. In the reaction apparatus shown in FIG. 7, folded parts and fins are formed on the end portion of lower level stirring blade. In the reaction apparatus shown in FIG. 8, slits are formed on the upper level stirring blade and folded parts and fins are formed on the end portion of lower level stirring blade. In the reaction apparatus shown in FIG. 9, 3 leveled stirring blades are installed. The folded angle is preferably between 5 and 45 degrees when said folded sections are formed.

Stirring blades having such folded sections 4" or 5", stirring blades which have upward and downward projections (fins) 4' or 5', all generate an effective turbulent flow.

Still further, the space between the upper and the lower stirring blades is not particularly limited, but it is preferable that such a space is provided between stirring blades. The specific reason is not clearly understood. It is assumed that a flow of the medium is formed through said space, and the stirring efficiency is improved. However, the space is generally in the range of 0.5 to 50 percent with respect to the height of the liquid surface in a stationary state, and is preferably in the range of 1 to 30 percent.

Further, the size of the stirring blade is not particularly limited, but the sum height of all stirring blades is between 50 and 100 percent with respect to the liquid height in the stationary state, and is preferably between 60 and 95 percent.

Figure 7:
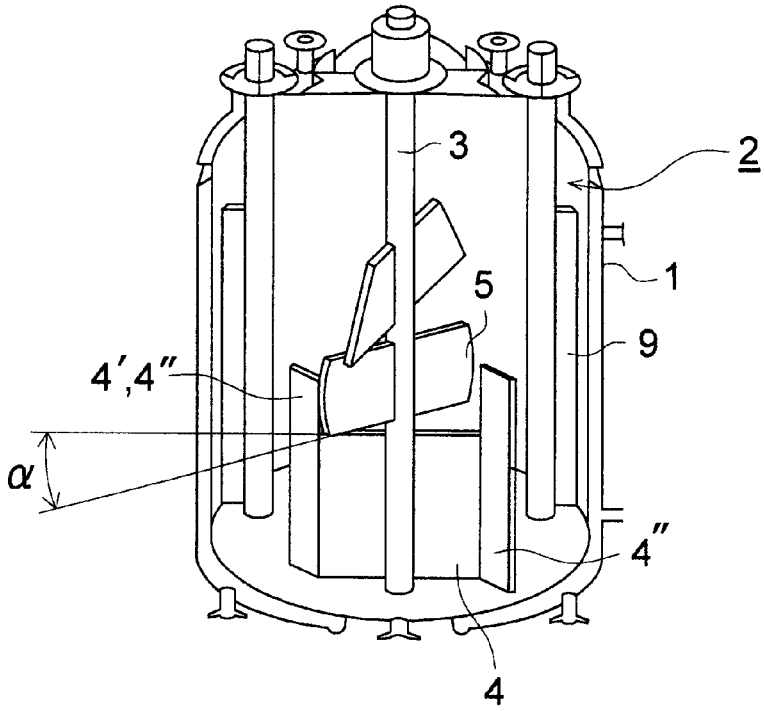
FIG. 7 is a perspective view of still another example of a stirring tank equipped with stirring blades.
Figure 8:
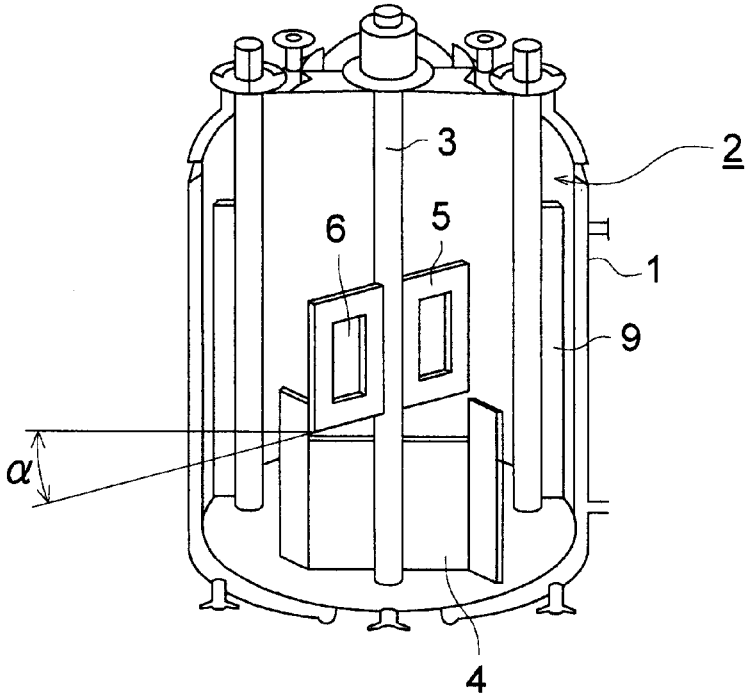
FIG. 8 is a perspective view of yet another example of a stirring tank equipped with stirring blades.
Figure 9:
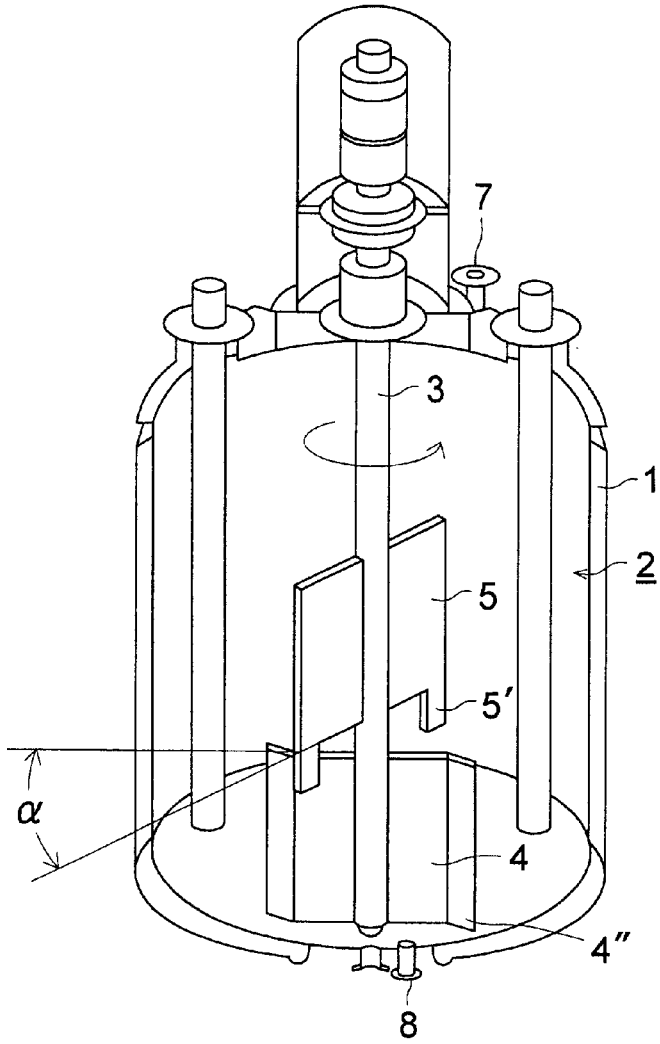
FIG. 9 is a perspective view of a final example of a stirring tank equipped with stirring blades.

Still further, FIG. 7 shows one example of a reaction apparatus employed when a laminar flow is formed in the suspension polymerization method. Said reaction apparatus is characterized in that turbulent flow forming member, obstacles such as a baffle plate, is not provided. In this instance it is preferable to employ plural blades configuration, wherein the upper level stirring blades are arranged with respect to the lower level stirring blade so as to have a crossed axis angle α advanced in the rotation direction, similarly to those employed to form turbulent flow.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 4(*a*), which are formed of a continuous plane are preferable, and those having a curved plane may also be employed.

In the method of polymerization employing salting-out or fusing resinous particles in water based medium, it is possible to control the shape and its distribution of the whole toner optionally by controlling the flow of medium and temperature in a reaction tank during the fusion process and also controlling the heating temperature, rotation number of stirring and time during the shape control process after fusion process.

In other word, in the method of polymerization employing salting-out or fusing resinous particles in water based medium, it is possible to prepare a toner having the shape coefficient and uniform shape distribution according to the invention by making the flow laminar in a reaction tank during the fusion process and employing stirring blades and stirring tank which enable to make the temperature distribution uniform in the tank and controlling the heating temperature, rotation number of stirring and time during the fusion process and shape control process. The reason is assumed that the shape distribution becomes uniform because a strong stress is not applied to the particles during coagulation and fusion and, as a result, the temperature distribution in the tank is uniform in the laminar flow with accelerated speed when fusion is conducted in the laminar flow. Further shape of the toner particles are optionally controlled since the fused particles are made spherical gradually by heating and stirring during the shape controlling process thereafter.

The coagulated particles of the resinous particles with colorant is called colored particle. The colored particle can be employed as a toner particle with or without addition of external additives such as silica fine particles. The shape or size of the particle are not substantially different with or without the addition of such additives.

For a stirring blade and stirring tank employed in the coagulation or fusion polymerization method, it is applicable those employed in the suspension polymerization method wherein a laminar flow is formed, for example those shown in FIG. 7. Said reaction apparatus is characterized in that turbulent flow forming member, obstacles such as a baffle plate, is not provided. In this instance it is preferable to employ plural blades configuration, wherein the upper level stirring blades are arranged with respect to the lower level stirring blade so as to have a crossed axis angle α advanced in the rotation direction, similarly to those employed to form turbulent flow.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 4(*a*), which are formed of a continuous plane are preferable, and those having a curved plane may also be employed.

Further, as the toner shape of the present invention, an average value (an average circularity) of the shape coefficient (circularity) described by the formula (2) shown below is preferably from 0.930 to 0.980, and is more preferably from 0.940 to 0.975.

$$\text{Shape coefficient}=(\text{circumferential length of a circle obtained based on the diameter equivalent to a circle})/(\text{circumferential length of the projected toner image}) \quad (2)$$

The shape coefficient preferably has a narrow distribution, and the standard deviation of the circularity is preferably not more than 0.10. The CV value obtained by the formula (3) shown below is preferably less than 20 percent, and is more preferably less than 10 percent.

$$\text{CV value}=(\text{standard deviation of circularity}/\text{average circularity})\times 100 \quad (3)$$

By adjusting said average circularity to the range of from 0.930 to 0.980, it is possible to make the toner shape undefined and to make heat transfer more efficient so that fixability can be further improved. Namely, by adjusting the average circularity to not more than 0.980, it is possible to enhance fixability. Further by adjusting the average circularity to at least 0.930, the degree of undefined particle shape is controlled so that pulverization properties of particles due to stress during extended use can be retarded.

By adjusting the standard deviation of the circularity to not more than 0.10, it is possible to prepare toner particles having a uniform shape and to minimize the difference in fixability between toner particles. As a result, an increase in the fixing ratio as well as effects to minimize staining of the fixing unit is further exhibited. Further, by adjusting the CV value to less than 20 percent, it is possible to narrow the size distribution in the same manner and to more markedly exhibit fixability enhancing effects.

Methods for measuring said shape coefficient are not limited. For example, toner particles are enlarged by a factor of 500 employing an electron microscope and photographed. Subsequently, the circularity of at least 500 toner particles is determined, employing an image analysis apparatus. The arithmetic average is then obtained so that an average circularity can be calculated. Further, as a simple measurement method, it is possible to conduct measurement, employing FPIA-1000 (produced by Toa Iyodenshi Co., Ltd.).

The optimal finishing time of processes may be determined while monitoring the properties of forming toner particles (colored particles) during processes of polymerization, fusion, and shape control of resinous particles to control the shape of particles.

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by Toa Iyodenshi Co.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

The volume average particle diameter of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 μm aperture. The volume and the number of particles having a diameter of at least 2 μm were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The diameter of the toner particles of the present invention is preferably between 3 and 8 μm in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 μm, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

Furthermore, the toner of the present invention may be advantageously employed when combined with external additives of fine particles, such as fine inorganic particles and fine organic particles. As the reason for such combining, it is assumed that burying and releasing of external additives may be effectively minimized, and its effect is markedly exhibited.

Preferably employed as such fine inorganic particles are inorganic oxide particles such as silica, titania, alumina, and the like. These fine inorganic particles are preferably subjected to hydrophobic treatment employing silane coupling agents, titanium coupling agents, and the like. The degree of the hydrophobic treatment is not particularly limited, however the degree is preferably between 40 and 95 measured as methanol wettability. The methanol wettability as described herein means the evaluation of wettability for methanol.

In this method, 0.2 g of fine inorganic particles is weighed and added to 50 ml of distilled water placed in a 200 ml beaker. Methanol is slowly added dropwise while slowly stirring from a burette of which top is immersed in the solution until entire fine organic particles are wet. The degree of hydrophobicity is calculated from the formula (4) given below:

$$\text{Degree of hydrophobicity}=a/(a+50)\times 100 \quad (4)$$

wherein "a" (in ml) represents the amount of methanol required for making fine inorganic particles perfectly wet.

The added amount of said external additives is between 0.1 and 5.0 percent by weight of the toner, and is preferably between 0.5 and 4.0 percent by weight. As external additives, various materials may be employed in combination.

<Developer>

Several cases may be considered for application of the toner of the present invention, in which, for example, comprising magnetic materials, it is employed as a single component magnetic toner; mixed with a so-called carrier, it is employed as a two-component toner; or a non-magnetic toner is individually employed; and the like. Said toner may be suitably employed for all cases. However, in the present invention, mixed with the carrier, the toner is preferably employed as a two-component developer material.

Employed as carriers constituting the two-component developer material, may be materials which are conventionally known in the art, such as metals, e.g., iron, ferrite, magnetite, and the like, and alloys of said metals with metals such as aluminum, lead, and the like, as magnetic particles. Specifically, ferrite particles are preferred. The volume average particle diameter of said magnetic particles is preferably between 15 and 100 μm, and is more preferably between 25 and 60 μm. The volume average particle diameter of carrier may be measured employing a laser diffraction type particle size distribution measuring device, "HELOS" (manufactured by SYNPATEC Co.) equipped with a wet-type homogenizer as a representative device.

Preferred carriers are those which are further coated with a resin or a so-called resin-dispersed type carrier prepared by dispersing magnetic particles into a resin. Resin compositions for coating are not particularly limited. For example, employed may be olefin based resins, styrene based resins, styrene/acryl based resins, silicone based resins, ester based resins, fluorine containing polymer based resins, and the like. Furthermore, resins to constitute the resin-dispersed type carrier are also not particularly limited, and those known in the art may be employed. For example, employed may be styrene acrylic resins, polyester resins, fluorine based resins, phenol resins, and the like.

<Image Forming Method>

Figure 10:
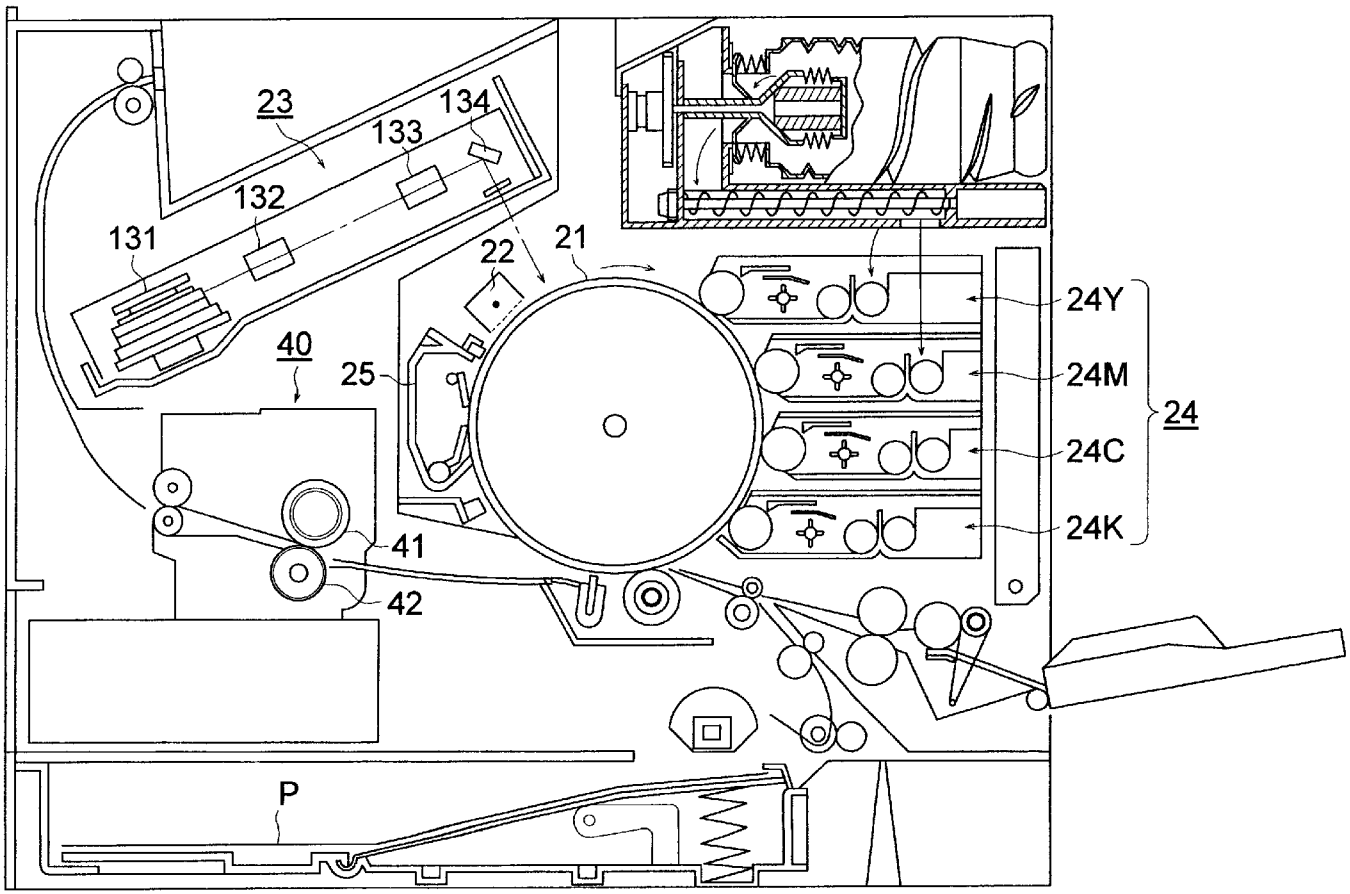
FIG. 10 is a cross-sectional schematic view of the color image forming apparatus of the present invention.

Herein, shown is the cross-sectional view of a color image forming apparatus as one example of the image forming apparatus according to the present invention. In FIG. 10, numeral 21 is a photoreceptor drum which is a latent image bearing body. Said photoreceptor drum is prepared by applying an OPC photoreceptor (an organic photoreceptor) onto the drum substrate, and rotates clockwise as shown in FIG. 10, while being grounded. Numeral 22 is a scorotron charging unit, employed as a charging means, which results in uniform charging at high electric potential VH on the circumferential surface of said photoreceptor drum 21, utilizing the electric potential maintained grid at grid electric potential VG as well as corona discharge wires. Prior to charging employing said scorotron charging unit, it is preferable that in order to eliminate the hysteresis of said photoreceptor until previous prints, the circumferential surface of said photoreceptor is subjected to charge elimination through pre-exposure employing PCL (pre-charging charge eliminator), utilizing light-emitting diodes and the like.

After uniformly charging photoreceptor 21, image exposure is carried out based on image signals, employing exposure means 23. Exposure means 23 comprises a light emitting source comprised of a laser diode (not shown), and the primary scanning is carried out in such a manner that the emitted light passes through rotating polygonal mirror 131, fθ lens 132, and cylindrical lens 133, and deflected its light path with reflection mirror 134.

In synchronizing with the rotation (secondary scanning) of photoreceptor drum 21, image exposure is carried out to form latent images. In the present example, the exposure of a text area is carried out and the reversal image is formed so that the text area results in lower electric potential VL.

Around photoreceptor drum 21, development means 24Y, 24M, 24C, and 24K are disposed, which comprise each of two components developers comprised of yellow (Y), magenta (M), cyan (C), black (K) toners, and the like, and carriers.

Image forming processes will be now described. First, as a first color, for example, yellow development is carried out. A common developer is comprised of a carrier comprised of ferrite cores of which surface coated with insulating resins, and a toner comprised of polyester particles as the main material, desired pigments, charge control agents, silica, titanium oxide, and the like. The layer of said developer is formed on a development sleeve employing a layer forming means, and the thickness is adjusted to from 100 to 600 $\mu$m. Subsequently, the resulting developer is conveyed to a development zone.

In the development zone, the gap between said development sleeve and photoreceptor drum 21 is set in the range of from 0.2 to 1.0 mm which is larger than the thickness of said developer layer. AC bias of VAC and DC bias of VDC are superposed and applied to said gap. Since the polarity of VDC and VH, and the charge of toner is the same as each other, the toner, which is provided with a chance to leave from the carrier due to VAC, does not adhere to a VH area, having a higher electric potential than VDC, but adheres to a VL area having a lower electric potential than VDC. As a result, an image is visualized (reversal development).

After completing image visualization of the first color, the magenta image forming process of a second color starts. Uniform charging is again carried out employing said scorotron charging unit, and a latent image is formed based on the second color image data, employing said exposure means 23.

The entire circumferential surface of photoreceptor drum 21 is again charged at VH electric potential. Subsequently, a latent image, which is the same as in the first color, is formed on the area, which has not been used for the first color image, and then developed. In the first color image area which is subjected to the repeated development, a VM' latent image is formed due to the light-shielding by the adhered toner of the fist color and the charge of the toner itself, and development is carried out in accordance with the difference in electric potential between VDC and VM'. In the superimposed area of said first color and second color, when the first color development is carried out upon forming a VL latent image, the balance between the first color and the second color is lost. Therefore, the exposure amount for the first color is reduced and occasionally, intermediate electric potential VM is used so as to be VH>VM>VL.

Regarding a third color cyan, and a fourth color black, image forming processes, which are the same as for magenta, are carried out, and four visualized color images are formed on the circumferential surface of said photoreceptor drum 21.

On the other hand, a sheet of recording material (recording sheet of paper, and the like) P, which is conveyed from a paper feeding cassette via a half-moon roller, temporarily stops near the pair of a resist roller (paper feeding roller) via a feed-out roller, and is then conveyed to a transfer zone by the rotation action of said resist rollers, when transfer timing is matched.

In said transfer zone, a transfer means is brought into pressure contact with the circumferential surface of photoreceptor drum 21, while being synchronized with transfer timing, and the fed recording material P is introduced between them so that multicolor images are inclusively transferred.

Subsequently, recording material is subjected to charge elimination, utilizing a separation means, separated from the circumferential surface of photoreceptor drum 21, and conveyed to a fixing unit (a fixing means) 40. In said fixing unit, heat and pressure are applied to the toner employing heating roller (an upper roller) 41 and pressure applying roller (a lower roller) 42 so that said toner is melt-fixed. Thereafter, resulting recording material P is ejected onto a paper ejecting tray via a paper ejecting roller. Incidentally, after passing said recording material P, said transfer means withdraws from the circumferential surface of photoreceptor drum 21, and prepares for next toner image formation.

On the other hand, photoreceptor drum 21, which is separated from recording material P, is subjected to charge eliminating employing a charge eliminator, and thereafter, is subjected to removal of the residual toner and cleaning through pressure contact with the blade of cleaning means 25. Subsequently, said photoreceptor drum 21 is again subjected to charge elimination employing said PCL, and then is charged employing said scorotron charging unit, and enters into next image forming process. Incidentally, after cleaning the photoreceptor surface, said blade immediately moves and withdraws from the circumferential surface of photoreceptor drum 21. The waste toner, which is scraped into cleaning means 25 employing said blade, is discharged employing screws, and stored in the waste toner recovery container (not shown).

As suitable fixing methods employed in the present invention, it is possible to list so-called contact heating systems. Specifically, as said contact heating systems, it is possible to list a heat pressure fixing system, a heating roll fixing system, and a pressure contact heat fixing system in which fixing is carried out employing a rotating pressure applying member including a heating body stationary fixed.

The heat roller fixing system is often constituted employing an upper roller prepared in such a manner that a cylindrical metal roller comprised of iron, aluminum, and the like, having a heating source in the interior is covered with tetrafluoroethylene, polytetrafluoroethylene-perfluoroalkoxyvinyl ether copolymers and the like, and a lower roller comprised of silicone rubber and the like. The representative example of said heating source is one which comprises a line shaped heater and heats the surface of said upper roller in the temperature range of from 120 to 200° C. In the fixing section, pressure is applied between the upper roller and the lower roller so that the lower roller is deformed to form so-called nip. The width of said nip is generally from 1 to 10 mm, and is preferably from 1.5 to 7 mm. The linear speed of fixing is preferably from 40 to 600 mm/second. When said nip is narrow, it is extremely difficult to uniformly provide heat to toner, whereby non-uniform fixing occurs. On the other hand, when said nip is broad, the melt of resins is accelerated, whereby problems occur in which excessive fixing offsetting results.

Fixing cleaning mechanisms may be provided. As this system, it is possible to employ a system which supplies silicone oil onto an upper fixing roller or films, and a method which carries out cleaning, employing a pad impregnated with silicone oil, a roller, a web and the like.

Said fixing unit may be provided with said cleaning mechanism. Employed as cleaning systems are a system in which various types of silicone oil are supplied to a fixing film, or a system which carries out cleaning, employing a pad impregnated with silicone oil, a roller, a web and the like.

Incidentally, as silicone oil, it is possible to employ polydimethylsiloxane, polymethylphenysiloxane, polydiphenylsiloxane, and the like. Further, it is possible to suitably use siloxanes comprising fluorine.

EXAMPLE

The representative embodiments of the present invention will now be described as examples.

<Preparation Example of Latex>

A solution which had been prepared by dissolving 7.08 g of an anionic surface active agent (sodium dodecylbenzenesulfonate: SDS) in deionized water (2,760 g) was charged into a 5,000 ml separable flask fitted with a stirring unit, a thermal sensor, a cooling pipe, and a nitrogen gas inlet unit. Said solution was stirred at 230 rpm under a nitrogen atmosphere, and the interior temperature was raised to 80° C. Separately, 72.0 g of combination of releasing agents with content ratio shown in Table 1 was added to a monomer comprised of 115.1 g of styrene, 42.0 g of n-butyl acrylate, and 10.9 g of methacrylic acid, and were dissolved while being heated to prepare a monomer solution.

Herein, both said heated solutions were mix-dispersed employing a mechanical type homogenizer having a circulation channel, and emulsified particles, having a uniform dispersed particle diameter were obtained. Subsequently, a solution prepared by dissolving 0.84 g of a polymerization initiator (potassium persulfate: KPS) in 200 g of deionized water was added to the resulting dispersion, and the resulting mixture was heated at 80° C. for 3 hours to form latex particles. Subsequently, a solution prepared by dissolving 7.73 g of a polymerization initiator (KPS) in 240 g of deionized water was further added, and 15 minutes later, a composition prepared by mixing 383.6 g of styrene, 140.0 g of n-butyl acrylate, 36.4 g of methacrylic acid, and 15.0 g of n-octyl -3-mercaptopropionate was added dropwise over 100 minutes. After the dropwise addition, the resulting mixture was stirred for 60 minutes under heat, and then cooled to 40° C. to obtain latex particles.

Said resulting latex was designated as Latexes 1 through 5.

In Table 1, compound numbers of the releasing agents, number of carbon atom of $R_2$ and content ratio are shown.

TABLE 1

| | Exemplified Releasing Agent | | | |
|---|---|---|---|---|
| Latex No. | Compound No. | Carbon | Number of $R_2$ | Content Ratio |
| Latex 1 | 21 | N | 21 | 91.0 |
| (Example of | 22 | N − 2 | 19 | 5.5 |
| N = 21) | 23 | N − 4 | 17 | 1.8 |
| | 24 | N − 6 | 15 | 0.5 |
| | 20 | N + 2 | 23 | 1.2 |
| Latex 2 | 22 | N | 19 | 91.3 |
| (Example of | 23 | N − 2 | 17 | 5.0 |
| N = 19) | 24 | N − 4 | 15 | 1.8 |
| | 25 | N − 6 | 13 | 0.4 |
| | 21 | N + 2 | 21 | 1.5 |
| Latex 3 | 20 | N | 23 | 88.5 |
| (Example of | 21 | N − 2 | 21 | 7.2 |
| N = 23) | 22 | N − 4 | 19 | 1.8 |
| | 23 | N − 6 | 17 | 1.5 |
| | 19 | N + 2 | 25 | 1.0 |
| Latex 4 | 21 | N | 21 | 71.0 |
| (Comparative | 22 | N − 2 | 19 | 15.0 |
| Example of | 23 | N − 4 | 17 | 6.0 |
| N = 21) 24 | N − 6 | 15 | 3.0 | |
| | 20 | N + 2 | 23 | 5.0 |
| Latex 5 | 22 | N | 19 | 100.0 |
| (Comparative | 23 | N − 2 | 17 | 0.0 |
| Example of | 24 | N − 4 | 15 | 0.0 |
| N = 19) | 25 | N − 6 | 13 | 0.0 |
| | 21 | N + 2 | 21 | 0.0 |

(Colored Particles Preparation Example)

Preparation of Colored Particles 1–5

While stirring, dissolved in 160 ml of deionized were 9.2 g of sodium dodecylsulfate. While stirring, gradually added to the resulting solution were 20 g of Regal 330R (carbon black manufactured by Cabot Corp.), and the resulting mixture was dispersed employing a Clearmix. The particle diameter of said dispersion was determined employing an Electrophoresis Light Scattering Photometer ELS-800 manufactured by Ohtsuka Denshi Co., whereby a weight average particle diameter of 112 nm was determined. Said dispersion was designated as "Colorant Dispersion 1Bk".

While stirring, charged into 5000 milliliter 4-necked flask fitted with a thermal sensor, a cooling pipe, a nitrogen inlet unit, and a stirring unit were 1,250 g of said "Latex 1", 2,000 g of deionized water, and "Colorant Dispersion 1Bk". After heating the resulting mixture to 30° C., 5N aqueous sodium hydroxide solution was added to said solution, after which the pH was adjusted to 10.0. Subsequently, an aqueous solution prepared by dissolving 52.6 g of magnesium hydroxide hexahydrate in 72 g of deionized water was added while stirring at 30° C. over 10 minutes.

Thereafter, the resulting mixture was set aside for 3 minutes, and then heated to 90° C. within 6 minutes (temperature raising rate=10° C./minute). In such a state, the particle diameter was determined employing a Coulter Counter TA-II. When the volume average particle diameter reached 6.5 $\mu$m, an aqueous solution prepared by dissolving 115 g of sodium chloride in 700 g of deionized water was added to stop the particle growth. Subsequently, while maintaining the resulting mixture at 90±2° C., said mixture was stirred for 6 hours, and was subjected to salting-out/fusion. Thereafter, the resulting product was cooled to 30° C. at a rate of 6° C./minute, and the pH was adjusted to 2.0 by addition of hydrochloric acid. Then, stirring was stopped. The prepared colored particles were filtered and repeatedly washed with deionized water. Thereafter the resulting colored particles were dried employing 40° C. air to obtain colored particles. Colored particles obtained as above were designated as "Colored Particles 1Bk".

Colored Particles 1Y through 5C were obtained in the same manner as Colored Particles 1Bk, except that the colorants were replaced with those shown in Table 2 by employing the Latex 2 through Latex 5.

Latex number and the colorants employed in the Colored Particles 1 through 5 are listed in Table 2.

TABLE 2

| Colored Particles No. | | Latex No. | Colorant Name |
|---|---|---|---|
| Colored Particles | Bk | Latex 1 | Regal 330R |
| Group 1 | Y | Latex 1 | C.I. Pigment Yellow 185 |
| | M | Latex 1 | C.I. Pigment Red 122 |
| | C | Latex 1 | C.I. Pigment Blue 15:3 |
| Colored Particles | Bk | Latex 2 | Regal 330R |
| Group 2 | Y | Latex 2 | C.I. Pigment Yellow 185 |
| | M | Latex 2 | C.I. Pigment Red 122 |

TABLE 2-continued

| Colored Particles No. | | Latex No. | Colorant Name |
|---|---|---|---|
| | C | Latex 2 | C.I. Pigment Blue 15:3 |
| Colored Particles Group 3 | Bk | Latex 3 | Regal 330R |
| | Y | Latex 3 | C.I. Pigment Yellow 185 |
| | M | Latex 3 | C.I. Pigment Red 122 |
| | C | Latex 3 | C.I. Pigment Blue 15:3 |
| Colored Particles Group 4 | Bk | Latex 4 | Regal 330R |
| | Y | Latex 4 | C.I. Pigment Yellow 185 |
| | M | Latex 4 | C.I. Pigment Red 122 |
| | C | Latex 4 | C.I. Pigment Blue 15:3 |
| Colored Particles Group 5 | Bk | Latex 5 | Regal 330R |
| | Y | Latex 5 | C.I. Pigment Yellow 185 |
| | M | Latex 5 | C.I. Pigment Red 122 |
| | C | Latex 5 | C.I. Pigment Blue 15:3 |

(Colored Particles Preparation Example)

Charged into a 4-necked flask fitted with a high speed stirring unit (a TK Homomixer) were 710 parts by weight of deionized water and 450 parts by weight of 0.1 mole/liter aqueous trisodium phosphate solution, and the resulting mixture was heated to 65° C. Subsequently, 68 parts by weight of 1.0 mole/liter calcium chloride were gradually added under the stirring condition of 12,000 rpm, whereby a water based dispersion medium comprised of a dispersion containing colloidal tricalcium phosphate was prepared.

Subsequently, 30 parts by weight of Ester Wax (19) were added to a dispersion which had been prepared by dispersing 165 parts by weight of styrene monomer, 35 parts by weight of n-butyl acrylate, and 14 parts by weight of carbon black (Regal 330R) employing a sand grinder, and were dissolved at 80° C. Thereafter, 2 parts by weight of n-octyl-3-mercaptopropionate and 10 parts by weight of 2,2'-azobis (2,4-dimethylvaleronitile), as the polymerization initiator, were gradually added to said water based dispersion medium while stirred at 12,000 rpm, whereby a solution comprising monomers was dispersed into water. Subsequently, the resulting dispersion underwent polymerization under a nitrogen gas flow at 65° C. for 10 hours while stirred at 200 rpm, employing a reaction apparatus in which the stirring blade was constituted as shown in FIG. 4(*b*).

After completing said polymerization, hydrochloric acid was added to remove tricalcium phosphate as the dispersion stabilizer. The resulting medium was then filtered, washed, and dried, whereby "Colored Particles 6Bk" were prepared.

Incidentally, during said polymerization, monitoring was performed. By controlling the liquid medium temperature, the rotation frequency of the stirrer, and the heating time, the shape as well as the variation coefficient of the shape coefficient was controlled. Further, the particle diameter, as well as the variation coefficient of the particle size distribution, was controlled as desired utilizing a classification method in a liquid medium.

The releasing agents, number of carbon atom thereof and content ratio are shown in Table 3.

TABLE 3

| | Exemplified Releasing Agent | | | |
|---|---|---|---|---|
| Latex No. | Compound No. | Carbon | Number of $R_2$ | Content Ratio |
| Colored Particles (Example of N = 21) | 21 | N | 21 | 91.0 |
| | 22 | N − 2 | 19 | 5.5 |
| | 23 | N − 4 | 17 | 1.8 |
| | 24 | N − 6 | 15 | 0.5 |
| | 20 | N + 2 | 23 | 1.2 |

TABLE 3-continued

| | Exemplified Releasing Agent | | | |
|---|---|---|---|---|
| Latex No. | Compound No. | Carbon | Number of $R_2$ | Content Ratio |
| Colored Particles 7 (Example of N = 19) | 22 | N | 19 | 91.3 |
| | 23 | N − 2 | 17 | 5.0 |
| | 24 | N − 4 | 15 | 1.8 |
| | 25 | N − 6 | 13 | 0.4 |
| | 21 | N + 2 | 21 | 1.5 |
| Colored Particles 8 (Example of N = 23) | 20 | N | 23 | 88.5 |
| | 21 | N − 2 | 21 | 7.2 |
| | 22 | N − 4 | 19 | 1.8 |
| | 23 | N − 6 | 17 | 1.5 |
| | 19 | N + 2 | 25 | 1.0 |
| Colored Particles 9 (Comparative Example of N = 21) | 21 | N | 21 | 71.0 |
| | 22 | N − 2 | 19 | 15.0 |
| | 23 | N − 4 | 17 | 6.0 |
| | 24 | N − 6 | 15 | 3.0 |
| | 20 | N + 2 | 23 | 5.0 |
| Colored Particles 10 (Comparative Example of N = 19) | 22 | N | 19 | 100.0 |
| | 23 | N − 2 | 17 | 0.0 |
| | 24 | N − 4 | 15 | 0.0 |
| | 25 | N − 6 | 13 | 0.0 |
| | 21 | N + 2 | 21 | 0.0 |

Colored Particles 6Y through 10C were obtained in the same manner as Colored Particles 6Bk, except that the colorants were replaced with those shown in Table 4 by employing the Colored Particles 2 through Colored Particles 5.

The colorants employed in the Colored Particles 6 through 10 are listed in Table 4.

TABLE 4

| Colored Particles | | Colorant Name |
|---|---|---|
| Colored Particles Group 6 | Bk | Regal 330R |
| | Y | C.I. Pigment Yellow 185 |
| | M | C.I. Pigment Red 122 |
| | C | C.I. Pigment Blue 15:3 |
| Colored Particles Group 7 | Bk | Regal 330R |
| | Y | C.I. Pigment Yellow 185 |
| | M | C.I. Pigment Red 122 |
| | C | C.I. Pigment Blue 15:3 |
| Colored Particles Group 8 | Bk | Regal 330R |
| | Y | C.I. Pigment Yellow 185 |
| | M | C.I. Pigment Red 122 |
| | C | C.I. Pigment Blue 15:3 |
| Colored Particles Group 9 | Bk | Regal 330R |
| | Y | C.I. Pigment Yellow 185 |
| | M | C.I. Pigment Red 122 |
| | C | C.I. Pigment Blue 15:3 |
| Colored Particles Group 10 | Bk | Regal 330R |
| | Y | C.I. Pigment Yellow 185 |
| | M | C.I. Pigment Red 122 |
| | C | C.I. Pigment Blue 15:3 |

Average circularity, standard deviation of circularity, circularity CV value and volume average particle diameter of the obtained colored particles 1 through 10 are listed.

TABLE 5

| Colored Particles | | Average Circularity | Standard Deviation of Circularity | Circularity CV Value (in %) | Volume Average Particle Diameter (in μm) |
|---|---|---|---|---|---|
| Colored Particles 1 | Bk | 0.964 | 0.031 | 3.2 | 6.5 |
| | Y | 0.966 | 0.033 | 3.4 | 6.4 |
| | M | 0.967 | 0.031 | 3.2 | 6.4 |
| | C | 0.966 | 0.033 | 3.4 | 6.6 |

TABLE 5-continued

| Colored Particles | | Average Circularity | Standard Deviation of Circularity | Circularity CV Value (in %) | Volume Average Particle Diameter (in μm) |
|---|---|---|---|---|---|
| Colored Particles 2 | Bk | 0.966 | 0.036 | 3.7 | 6.3 |
| | Y | 0.966 | 0.036 | 3.7 | 6.4 |
| | M | 0.967 | 0.038 | 3.9 | 6.4 |
| | C | 0.969 | 0.037 | 3.8 | 6.3 |
| Colored Particles 4 | Bk | 0.962 | 0.042 | 4.4 | 6.4 |
| | Y | 0.961 | 0.045 | 4.7 | 6.4 |
| | M | 0.965 | 0.044 | 4.6 | 6.4 |
| | C | 0.966 | 0.045 | 4.7 | 6.3 |
| Colored Particles 4 | Bk | 0.974 | 0.051 | 5.2 | 6.8 |
| | Y | 0.974 | 0.052 | 5.3 | 7.1 |
| | M | 0.972 | 0.050 | 5.2 | 6.9 |
| | C | 0.972 | 0.051 | 5.2 | 6.9 |
| Colored Particles 5 | Bk | 0.974 | 0.051 | 5.2 | 6.8 |
| | Y | 0.974 | 0.052 | 5.3 | 7.1 |
| | M | 0.972 | 0.050 | 5.2 | 6.9 |
| | C | 0.972 | 0.051 | 5.2 | 6.9 |
| Colored Particles 6 | Bk | 0.969 | 0.032 | 3.3 | 6.2 |
| | Y | 0.969 | 0.032 | 3.3 | 6.2 |
| | M | 0.969 | 0.032 | 3.3 | 6.2 |
| | C | 0.969 | 0.032 | 3.3 | 6.2 |
| Colored Particles 7 | Bk | 0.968 | 0.030 | 3.1 | 6.3 |
| | Y | 0.968 | 0.030 | 3.1 | 6.3 |
| | M | 0.968 | 0.030 | 3.1 | 6.3 |
| | C | 0.968 | 0.030 | 3.1 | 6.3 |
| Colored Particles 8 | Bk | 0.968 | 0.030 | 3.1 | 6.3 |
| | Y | 0.968 | 0.030 | 3.1 | 6.3 |
| | M | 0.968 | 0.030 | 3.1 | 6.3 |
| | C | 0.968 | 0.030 | 3.1 | 6.3 |
| Colored Particles 9 | Bk | 0.968 | 0.030 | 3.1 | 6.3 |
| | Y | 0.968 | 0.030 | 3.1 | 6.3 |
| | M | 0.968 | 0.030 | 3.1 | 6.3 |
| | C | 0.968 | 0.030 | 3.1 | 6.3 |
| Colored Particles 10 | Bk | 0.966 | 0.031 | 3.2 | 6.2 |
| | Y | 0.966 | 0.031 | 3.2 | 6.2 |
| | M | 0.966 | 0.031 | 3.2 | 6.2 |
| | C | 0.966 | 0.031 | 3.2 | 6.2 |

Said circularity was determined employing FPIA-1000, using an analyzed sample amount of 0.3 micro liter and the number of detected particles of from 1,500 to 5,000.

Characteristics of resin s employed in the colored particles groups 1–10 (Peak Molecular Weight of the High Molecular Weight Component, Peak Molecular Weight of the Low Molecular Weight Component, Measured Molecular Weight of Resin) are listed in Table 6.

TABLE 6

| Colored Particles (Group) No. | Peak Molecular Weight of the High Molecular Weight Component | Peak Molecular Weight of the Low Molecular Weight Component | Measured Molecular Weight of Resin: Number Average Molecular Weight | Measured Molecular Weight of Resin: Weight Average Molecular Weight |
|---|---|---|---|---|
| Colored Particles Group 1 | 243,000 | 21,000 | 5,900 | 43,000 |
| Colored Particles Group 2 | 242,000 | 22,000 | 5,800 | 45,000 |
| Colored Particles Group 3 | 242,000 | 20,000 | 5,900 | 48,000 |
| Colored Particles Group 4 | 242,000 | 21,000 | 5,900 | 43,000 |
| Colored Particles Group 5 | 251,000 | 19,000 | 5,900 | 49,000 |
| Colored Particles Group 6 | 243,000 | 21,000 | 5,900 | 43,000 |
| Colored Particles Group 7 | 245,000 | 19,000 | 6,300 | 56,000 |
| Colored Particles Group 8 | 269,000 | 20,000 | 7,200 | 69,000 |
| Colored Particles Group 9 | 242,000 | 21,000 | 5,000 | 42,000 |
| Colored Particles Group 10 | 242,000 | 19,000 | 4,300 | 51,000 |

Preparation Example of Tone>

Subsequently, 0.5 rcent by weight of hydrophobic silica (having a number average primary particle diameter of 12 nm and a degree of hydrophobicity of 68) and 0.5 rcent by weight of hydrophobic titanium oxide (having a number average primary particle diameter of 20 nm and a degree of hydrophobicity of 63) were added to each of said Colored Particles Group 1 "Colored Particles 1Bk/1Y/1M/1C" through Colored Particle Group 10 "Colored Particles 10Bk/10Y/10M/10C", and each mixture was blended employing a Henschel mixer to obtain a toner.

These toners were designated as Toner Group 1 "Toner 1Bk/1Y/1M/1C" through "Toner 10Bk/10Y/10M/10C".

<Preparation>

A silicone resin-coated ferrite carrier, having a volume average diameter of 60 μm, was mixed with each of said toners, and developers having a toner concentration of 6 percent were prepared. These toners were designated as Developer Group 1 "Developer 1Bk/1Y/1M/1C" through Developer Group 10 "Developer 10Bk/10Y/10M/10C", corresponding to toners.

Herein, employing each of the prepared developers, imaging evaluation was carried out utilizing a Digital Color Printer, Konica 3015, having the same constitution as shown in FIG. 10 except that the constitution of the fixing unit was modified as explained below.

Employed as the fixing unit was a heating fixing unit employing a pressure contact system as shown in FIG. 11. The specific constitution is as follows.

The fixing unit comprises as a heating roller (an upper roller) a 1.0 mm thick cylindrical aluminum alloy pipe 11 having an inner diameter of 40 mm and a total length of 310 mm, which comprises PFA (a tetrafluoroethylene-perfluoroalkyl vinyl ether copolymer) covered layer (having a thickness of 120 μm) on its surface and also comprises in its interior heater, and pressure applying roller (a lower roller) comprised of an iron pipe 16, having an inner diameter of 40 mm and a wall thickness of 2.0 mm, which comprises sponge silicone rubber (having an Asker C hardness of 48 and a thickness of 2 mm) on its surface.

The nip width was set at 5.8 mm. Said fixing unit was then employed, and the linear speed for printing was set at 250 mm/second.

<

Employed as the cleaning mechanism of said cleaning unit was a supply system utilizing a web system, which was impregnated with polydiphenylsilicone (having a viscosity of 10 Pa·s at 20° C.), was employed.

The fixing temperature was controlled utilizing the surface temperature of said upper roller, said temperature being set at 175° C. Incidentally, the coated amount of silicone oil was set to be at 0.6 mg/A4.

Evaluation of Characteristics

An A4 size monochromatic halftone image (having a relative reflection density of 1.0 when the density of a sheet of paper was "0") was printed utilizing each of Y/M/C/Bk, and subsequently, the fixing ratio was determined.

The fixing ratio, as described herein, was obtained as follows: a fixed image was rubbed with a 1 kg weight wrapped with bleached cotton cloth, and the ratio of differences in density of the image, before and after rubbing, was obtained as a percentage, using the formula (5) below.

$$\text{Fixing ratio (in percent)}=\{(\text{image density after rubbing}/(\text{image density before rubbing}))\times 100 \quad (5)$$

After 10,000 sheets copying of the above mentioned half tone image continuously in the normal condition (20° C., 50% RH) the test machine was allowed to rest for 12 hours, and then image stain on white paper copied from white original paper due to the roller of fixing unit was observed by eyes viewing.

Each of 50,000 sheets of a white original paper and a paper having an image of 1% pixel in each color were copied alternatively in high temperature and high humidity condition (30° C., 85% RH). Image density at black solid part and fog density at white solid part for initial copy and 50,000th copy were measured by means of RD-918 (manufactured by Macbeth Co., Ltd). Absolute reflective density was measured for the image density at solid black part, and relative reflective density taking the reflective density of paper being 0.0 was measured for the image density at white solid part.

Uneven glossiness of surface on the photoreceptor after 50,000 copying was observed by eyes view to find filming.

Test machine after 50,000 copying was set at a condition of 30° C. and 85% RH, then characters of 5.5 point size were printed on full area of A4 size paper and image blur caused by filming was observed.

Developer groups employed in the test and fixing ratio and image stain thereof are listed in Table 7.

TABLE 7

| | Developer (Group) No. | Fixing Ratio (in %) | Image Stain |
|---|---|---|---|
| Example 1 | Developer Group 1 | 95 | none |
| Example 2 | Developer Group 2 | 93 | none |
| Example 3 | Developer Group 3 | 94 | none |
| Example 4 | Developer Group 6 | 95 | none |
| Example 5 | Developer Group 7 | 93 | none |
| Example 6 | Developer Group 8 | 90 | none |
| Comparative Example 1 | Developer Group 4 | 95 | Slight Black Stripe |
| Comparative Example 2 | Developer Group 5 | 87 | Black Stripe |
| Comparative Example 3 | Developer Group 9 | 92 | Slight Black Stripe |
| Comparative Example 4 | Developer Group 10 | 83 | Black Stripe |

Developer groups, and the image density as well as image fog thereof are summarized in Table 8.

TABLE 8

| | Developer Group | Image Density Initial | Image Density 50,000th | Image Fog Initial | Image Fog 50,000th | Filming | Image Blur |
|---|---|---|---|---|---|---|---|
| Example 1 | Developer Group 1 | 1.42 | 1.40 | 0.000 | 0.001 | None | None |
| Example 2 | Developer Group 2 | 1.41 | 1.40 | 0.000 | 0.001 | None | None |
| Example 3 | Developer Group 3 | 1.42 | 1.41 | 0.000 | 0.001 | None | None |
| Example 4 | Developer Group 6 | 1.41 | 1.40 | 0.000 | 0.001 | None | None |
| Example 5 | Developer Group 7 | 1.41 | 1.40 | 0.000 | 0.001 | None | None |
| Example 6 | Developer Group 8 | 1.42 | 1.40 | 0.000 | 0.001 | None | None |
| Comparative Example 1 | Developer Group 4 | 1.41 | 1.26 | 0.000 | 0.002 | Found | Found |
| Comparative Example 2 | Developer Group 5 | 1.42 | 1.28 | 0.000 | 0.006 | Found | Found |
| Comparative Example 3 | Developer Group 5 | 1.41 | 1.22 | 0.001 | 0.008 | Found | Found |
| Comparative Example 3 | Developer Group 5 | 1.42 | 1.25 | 0.001 | 0.008 | Found | Found |

Examples 1 to 6 show advantage characteristics in any of fixing ratio, image stain, image density, fogging, filming and blurring.

What is claimed is:

1. A toner for developing an electrostatic latent image comprising a resin, a colorant and a releasing agent, the releasing agent comprising a mixture of a plurality of compounds represented by formula (1)

$$R_1—(OCO—R_2)_n \quad (1)$$

wherein n represents an integer of 1 to 8, $R_1$ is a hydrocarbon group having from 1 to 40 carbon atoms which may have a substituent, $R_2$ is a hydrocarbon group having from 8 to 40 carbon atoms which may have a substituent, wherein the mixture is composed of (a) from 80 to 90 weight % of the compound represented by Formula (1) wherein $R_2$ has N carbon atoms and N is an integer, from 3.0 to 10.0 weight % of the compound represented by Formula (1) wherein $R_2$ has N−2 carbon atoms, from 1.0 to 5.0 weight % of the compound represented by Formula (1) wherein $R_2$ has N−4 carbon atoms, from 0.1 to 2.0 weight % of the compound represented by Formula (1) wherein $R_2$ has N−6 carbon atoms, from 0.5 to 3.0 weight % of the compound represented by Formula (1) wherein $R_2$ has N+2 carbon atoms, (b) from 80 to 90 weight % of the compound represented by Formula (1) wherein $R_1$ has N carbon atoms, from 3.0 to 10.0 weight % of the compound represented by Formula (1) wherein $R_1$ has N−2 carbon atoms, from 1.0 to 5.0 weight % of the compound represented by Formula (1) wherein $R_1$ has N−4 carbon atoms, from 0.1 to 2.0 weight % of the compound represented by Formula (1) wherein $R_1$ has N−6 carbon atoms, from 0.5 to 3.0 weight % of the compound represented by Formula (1) wherein $R_1$ has N+2 carbon atoms.

2. The toner of claim 1, wherein the mixture is composed of from 80 to 90 weight % of the compound represented by Formula (1) wherein $R_2$ has N carbon atoms, from 3.0 to 10.0 weight % of the compound represented by Formula (1) wherein $R_2$ has N−2 carbon atoms, from 1.0 to 5.0 weight % of the compound represented by Formula (1) wherein $R_2$ has N−4 carbon atoms, from 0.1 to 2.0 weight % of the compound represented by Formula (1) wherein $R_2$ has N−6 carbon atoms, and from 0.5 to 3.0 weight % of the compound represented by Formula (1) wherein $R_2$ has N+2 carbon atoms.

3. The toner of claim 2, wherein N is from 8 to 36.

4. The toner of claim 1, wherein N is from 8 to 30.

5. The toner of claim 1, wherein n is 1 and $R_1$ is a hydrocarbon group having carbon atoms of from 13 to 31.

6. The toner of claim 1, wherein n is from 2 to 8 and $R_1$ is a hydrocarbon group having carbon atoms of from 2 to 15.

7. The toner of claim 1, wherein n is 3 or 4.

8. The toner of claim 1, wherein n is 4.

9. The toner of claim 1, wherein a toner particle of the toner is composed of fused resinous particles containing the releasing agent.

10. The toner of claim 1, which is obtained by fusing resinous particles containing the releasing agent in a water based medium.

11. The toner of claim 1, wherein the toner is obtained by fusing, in water based medium, resinous particles containing the releasing agent and colorant.

12. The toner of claim 1, wherein the toner is obtained by suspension polymerization of monomer composition containing monomer, the releasing agent and colorant in water based medium.

* * * * *